United States Patent [19]

Butt

[11] 4,272,462

[45] Jun. 9, 1981

[54] LIQUID WETTED GAS COOLED HEAT EXCHANGER

[75] Inventor: Alan G. Butt, La Crosse, Wis.

[73] Assignee: The Trane Company, La Crosse, Wis.

[21] Appl. No.: 185,860

[22] Filed: Sep. 11, 1980

[51] Int. Cl.[3] ..... B01F 3/04

[52] U.S. Cl. ..... 261/153; 165/65; 165/166; 165/DIG. 1; 261/112; 261/155; 261/156; 261/DIG. 11

[58] Field of Search ..... 261/112, 153, 155, 156, 261/DIG. 11, DIG. 77; 165/65, 166, DIG. 1

[56] References Cited

U.S. PATENT DOCUMENTS

| | | | |
|---|---|---|---|
| 2,485,849 | 10/1949 | Simmons | 261/112 |
| 2,825,210 | 3/1958 | Carr | 165/166 X |
| 3,256,930 | 6/1966 | Norback | 165/166 X |
| 3,274,752 | 9/1966 | Huyghe et al. | 261/153 X |
| 3,504,738 | 4/1970 | McGuffey | 261/153 X |
| 3,590,914 | 7/1971 | Duncan | 165/166 X |
| 3,995,689 | 12/1976 | Cates | 261/155 X |
| 4,036,596 | 7/1977 | Ogoshi et al. | 261/112 X |
| 4,096,214 | 6/1978 | Percevaut et al. | 261/112 X |
| 4,218,408 | 8/1980 | Henning et al. | 261/DIG. 11 |

FOREIGN PATENT DOCUMENTS

| | | | |
|---|---|---|---|
| 641260 | 1/1979 | U.S.S.R. | 261/153 |

*Primary Examiner*—Richard L. Chiesa

*Attorney, Agent, or Firm*—Carl M. Lewis; Peter D. Ferguson; Ronald M. Anderson

[57] ABSTRACT

An air cooled heat exchanger provided with water distribution means for wetting the surfaces of air flow passages with a thin film of water, which by evaporation enhances the cooling of a fluid. The fluid flows through the heat exchanger in passages arranged in generally parallel, spaced apart layers. A series of metallic fin sheets, extending between the layers, maintain the separation between the layers and define a plurality of air passages. Water is distributed into the air passages as a liquid through slot means disposed on the edge of the layers, at the side where the air stream enters the heat exchanger. The air stream causes the water to spread in a thin film over the surfaces of the air passages, resulting in improved cooling of the fluid by evaporation of the water. Provision is made for collecting any excess water at the side of the heat exchanger where the air stream exits.

15 Claims, 6 Drawing Figures

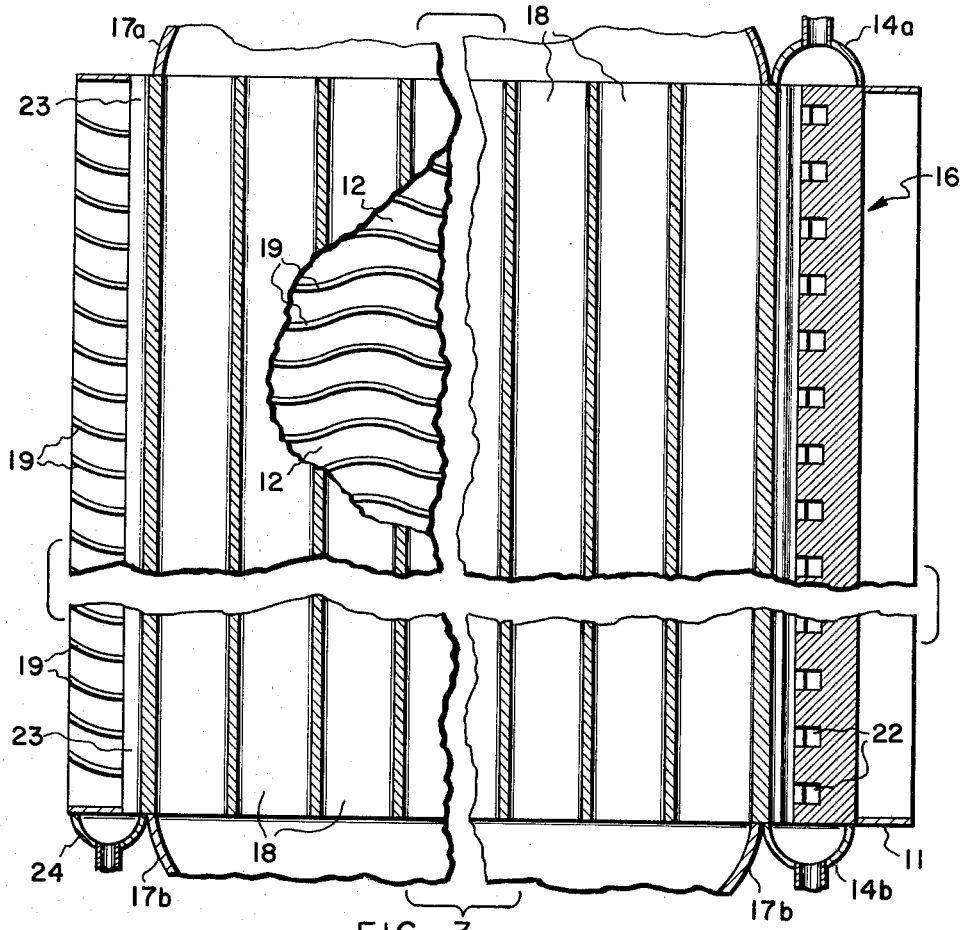
FIG. 3
FIG. 4
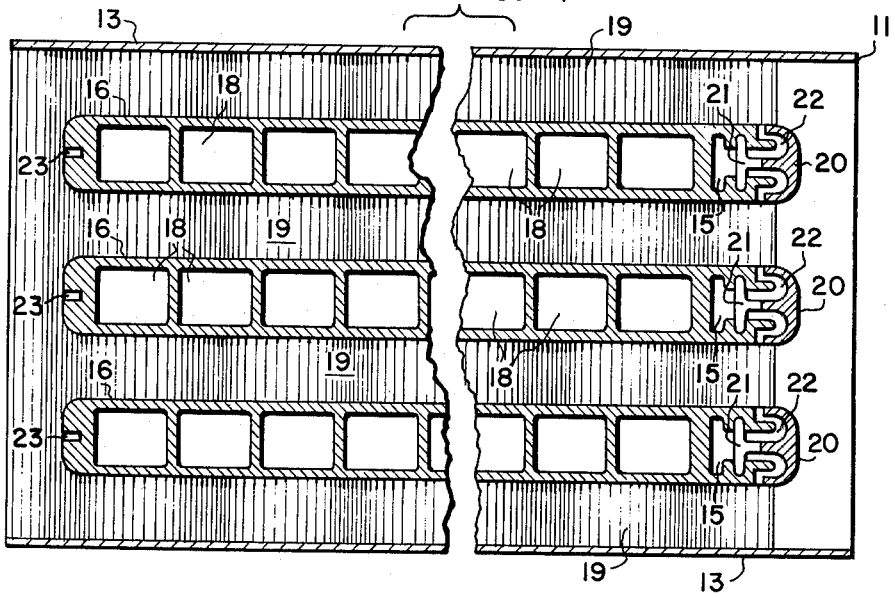

LIQUID WETTED GAS COOLED HEAT EXCHANGER

TECHNICAL FIELD

This invention generally pertains to gas cooled heat exchangers and specifically to liquid wetted gas cooled heat exchangers.

BACKGROUND ART

Ambient air is commonly used as a cooling medium in various types of heat exchanger applications ranging from the simple automotive radiator to large heat exchangers used in industrial processes. The operational capacity of such heat exchangers varies as a function of the temperature of the ambient air, and is therefor affected by seasonal or daily weather conditions.

At times, the ambient air temperature may rise too high for the heat exchanger to provide the required cooling capacity. In process applications, it may then become necessary to either temporarily suspend operation of the heat exchanger, or to utilize standby auxiliary cooling. However, auxiliary or mechanical cooling is expensive both in first cost and in operating cost. As an alternative, ambient air heat exchangers are sometimes provided with apparatus to spray water into their air passages to enhance their cooling capacity. The latent heat of vaporization required to evaporate the water droplets sprayed on the surfaces of the heat exchanger greatly increases the heat transferred from the other fluid flowing through the heat exchanger and provides the required cooling capacity when the ambient air temperature is too high.

Ambient air heat exchangers are also used with water spray apparatus on a continuous basis, where water is relatively abundant, to take advantage of the improvement in cooling capacity in those installations. For example, U.S. Pat. No. 2,485,849 discloses a heat exchanger or cooling tower provided with a plurality of liquid spray nozzles disposed above and adjacent to gas passages defined by undulating sheets. Gas flow across the undulating sheets through these passages is counter to the flow of liquid sprayed from the nozzles thereabove, and it is suggested that the turbulence introduced by the undulatins of these sheets facilitates greater contact between the liquid droplets in the spray, the liquid flowing down the sheets, and the gas moving upward through the passages. In the embodiment shown in the patent, water is used as the liquid, and air as the gas. Heat transfer occurs only between these two fluids, without provision for the cooling of a third fluid.

A problem noted in the above patent is the need to maximize contact between the liquid and gas moving through the common passages in order to obtain efficient heat transfer between the two. Similarly, when cooling a third fluid flowing through separate passages in a heat exchanger, it is especially important that the liquid, e.g., water, be distributed in a thin film over the outer surface of these separate passages and other adjacent surfaces within the heat exchanger, in order to maximize the heat transfer provided by evaporation of the liquid in the moving airstream. The spray nozzles or drip tube systems of the prior art do not provide adequate liquid distribution to achieve the desired uniform thin liquid film on these surfaces. Proper distribution of the liquid *before* it contacts the flowing gaseous fluid is the key to achieving a uniform liquid film and maximum heat transfer efficiency.

In consideration thereof, it is an object of this invention to provide a gas cooled heat exchanger wherein the evaporation of a liquid enhances the cooling of another fluid.

Another object of this invention is to provide means for uniformly distributing a thin film of liquid in the gaseous passages of the heat exchanger for effecting cooling of the other fluid by evaporation of the liquid film.

A further object of this invention is to provide means for maximizing the contact of the gaseous fluid with the liquid in the gaseous passages of the heat exchanger.

A still further object of this invention is to provide means for collecting any excess liquid which is not evaporated as it flows over the surfaces of the gaseous passages in the heat exchanger.

These and other objects of the present invention will be apparent from the description of the preferred embodiment and by reference to the attached drawings.

DISCLOSURE OF THE INVENTION

A heat exchanger is disclosed for cooling a first fluid conveyed through the heat exchanger in a plurality of first fluid passages formed in extruded layers, which are arranged in generally parallel spaced apart relationship. In between the extruded layers of the first fluid passages are disposed a plurality of gaseous fluid passages which are operative to convey a gaseous fluid through the heat exchanger in relatively fast moving streams generally transverse to the flow of the first fluid through the heat exchanger.

Liquid passages are disposed at the side of the heat exchanger where the gaseous fluid enters the gaseous fluid passages, along an edge of the extruded first fluid passage layers, and are operative to convey a liquid along that edge for distribution into the adjacent gaseous fluid passages.

A series of wavy fin sheets are disposed within the gaseous fluid passages in spaced apart arrangement. These sheets extend between adjacent extruded layers of the first fluid passages.

The liquid is distributed into the gaseous fluid passages by slot means formed in the liquid passages, and is induced to spread in a thin film on the surface of the fin sheets and over the adjacent surfaces of the first fluid passages downstream of the slot means, by the fast moving stream of the gaseous fluid. The evaporation of the thin film of liquid effects significant cooling of the first fluid.

BRIEF DESCRIPTION OF THE DRAWINGS

FIG. 3 is a partially broken-away sectional view of the invention showing one embodiment of the liquid passages and slot means, taken along section line 3—3 of FIG. 1.

FIG. 4 is a sectional view of the same embodiment taken along section line 4—4 of FIG. 1.

BEST MODE FOR CARRYING OUT THE INVENTION

Figure 1:
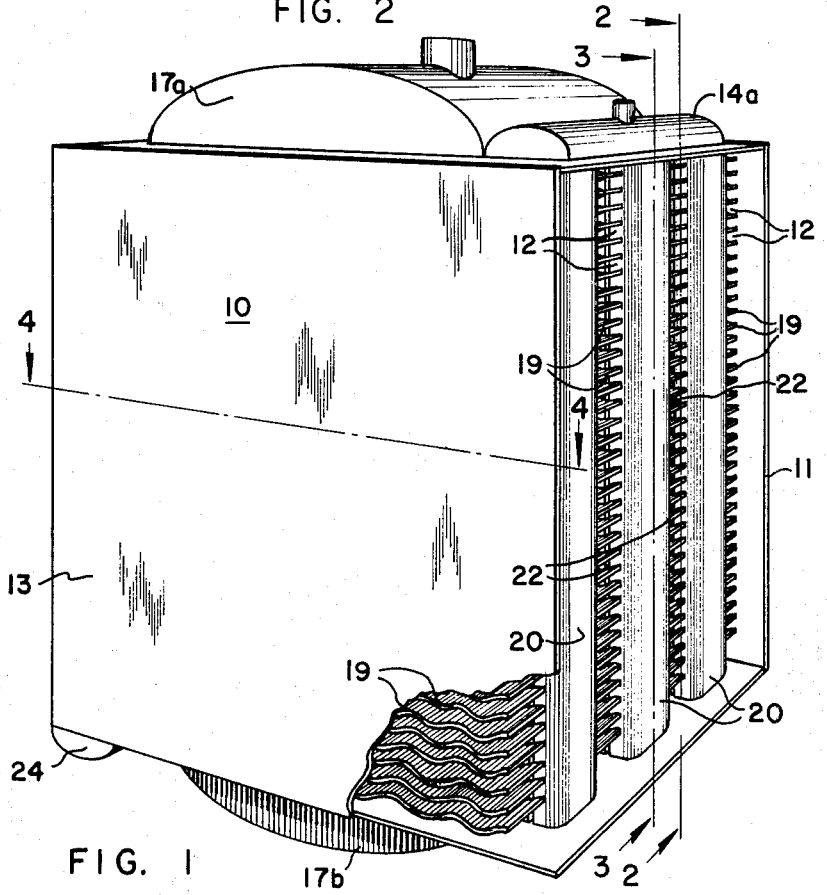
FIG. 1 shows a partially broken-away, perspective view of the subject invention.

With reference to FIG. 1, the subject invention is shown in perspective as a heat exchanger generally denoted by reference numeral 10. A gaseous fluid, ambient air in the preferred embodiment, is directed into an air inlet 11 along end edge of heat exchanger 10. A fan which is not shown provides the motive force to move the air through the heat exchanger 10. The air flows through the heat exchanger 10 within a plurality of gaseous fluid passages 12, exiting at the opposite edge.

Rectangular metallic sheets 13 provide closure for opposite sides of the heat exchanger 10. Liquid manifolds 14 are provided at the top and bottom of the heat exchanger 10 along the edge where air inlet 11 is disposed, and are in fluid communication with a plurality of liquid passages 15 formed on the leading edge of extruded layers 16, which extend the width of the heat exchanger 10. One of the liquid manifolds 14 serves as an inlet, in receipt of a pumped liquid; the other liquid manifold 14 serves to collect the residual water for return to a liquid reservoir and pump (not shown), in a closed loop system. In the preferred embodiment, the liquid passages 14 convey water to slot means for distribution into air passages 12, as will be explained hereinbelow.

Another fluid enters and exits the heat exchanger 10 through fluid manifolds 17, also disposed at each end of the heat exchanger 10. Manifolds 17 are in fluid communication with a plurality of other fluid passages 18 disposed within each of the extruded layers 16. The direction of fluid flow through fluid passages 18 is irrelevant for purposes of the operation of the invention, i.e., the other fluid may enter at one of the manifolds 17*a* and exit through the other manifold 17*b*, or vice versa. Similarly, although the direction in which the water flows through the heat exchanger in liquid passages 15 may effect the dimensional parameters of the slot means, the subject invention may be made to operate with water flow in either direction through liquid passages 15. Thus, water may enter at one of the manifolds 14*a* and exit through the other manifold 14*b*, or vice versa.

Figure 2:
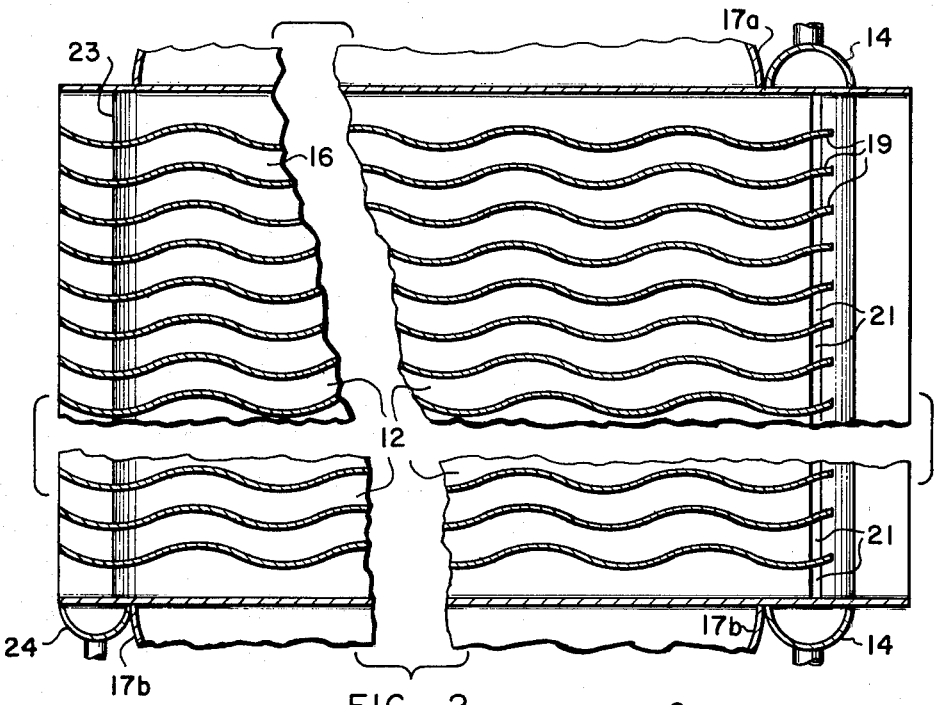
FIG. 2 is a sectional view of the invention shown in FIG. 1, taken along section line 2—2.

The extruded layers 16 are arranged generally parallel, and spaced apart by a series of wavy fin sheets 19 which define the gaseous fluid passages 12. The wavy fin sheets 19 extend from the liquid passages 15 across the width and depth of the heat exchanger 10, and beyond the opposite edges of the extruded layers 16, and are generally spaced equidistant from each other. The sectional view in FIG. 2 shows clearly the manner in which the wavy fin sheets 19 are disposed between the extruded layers 16.

Details of the extruded layers 16, fluid passages 18, and the first embodiment of the liquid passages 15 and slot means are shown in FIGS. 3 and 4. The fluid passages 18 are generally rectangular in cross section and extend the length of the extruded layer 16. The liquid passages 14 are formed along one edge of the extruded layers 16 with an additional extruded member 20 being pressed or slid into position in the matching grooves of the extruded layers (after the heat exchanger is brazed) to form the liquid passages 15 and the slot means for distributing the water into the air passages 12. The extruded members 20 include slots 21 machined at intervals along the length thereof. Area and spacing of slots 22 may be non-uniform in order to compensate for effect of water level on static-head. Water flowing in the liquid passages 15 is distributed into each of the gaseous fluid passages 12 through slot means comprising slots 21 and passages 22 formed by the extruded members 20 and the extruded layers 16.

On the opposite edge of each of the extruded layers 16, a drain slot 23 is provided running the length thereof. A drain collector 24 is disposed below the bottom portion of drain slot 23 along the trailing edge of the extruded layers 16. The purpose of drain slots 23 and drain collector 24 will be explained hereinbelow.

Figure 5:
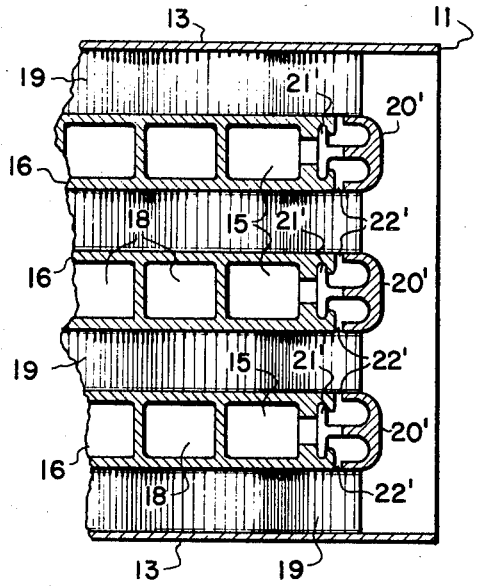
FIG. 5 shows a second embodiment of the liquid passages and slot means, illustrated in an equivalent sectional view to that of FIG. 4.
Figure 6:
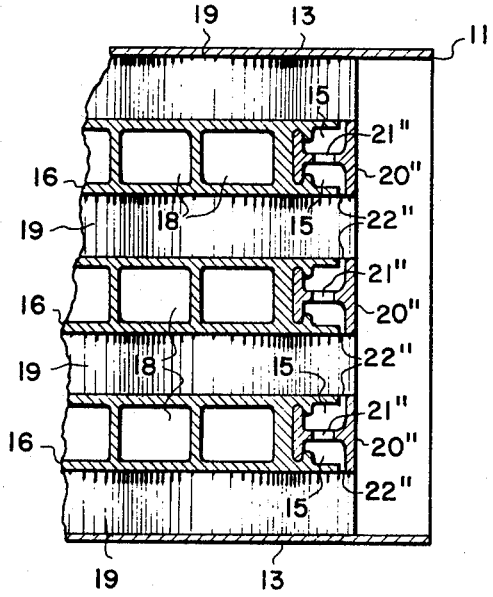
FIG. 6 is a sectional view showing the third embodiment of the liquid passages and slot means, also illustrated in a sectional view equivalent to that of FIG. 4.

Turning now to FIGS. 5 and 6, a second and third embodiment for the liquid passages 16 and the slot means are shown in cross section. In FIG. 5, the slot means comprise slots 21' machined in the ends of extruded layer 16, and passages 22' in the extruded members 20'. Likewise, in FIG. 6, the slot means comprise slots 21'' and passages 22'' in extruded members 20''. The liquid passages 15 shown for the second embodiment in FIG. 5 offer significant advantage over the other two embodiments in terms of cross-sectional area for increased liquid flow capacity; otherwise, the three embodiments are similar in function.

It is contemplated that the extruded layers 16, wavy fin sheets 19, and closing bars (not shown) will be assembled in a suitable jig and brazed in a salt flux bath or vacuum furnace in a manner well known to those skilled in the art. The extruded members 20, 20', or 20'' will be inserted, and manifolds 14 and 17 and the drain collector 24 will thereafter be welded into place.

In operation, water is pumped into the liquid manifold 14 and passes through the liquid passages 15, from which it flows through slots 21 and passages 22, thereby being distributed into each of the gaseous fluid passages 12. As the water spreads and wets the surfaces of wavy fin sheets 19, the point midway between the extruded layers 16 on the wavy fin sheets 19 will tend to be the coolest wetted surface. Therefore surface tension at that point should be at a maximum. This will have the effect of drawing water from the passages 22 and slots 21 onto the wavy fin sheets 19, from which the air stream will promote extension of the film downstream. In this manner a thin film of water will be induced to spread over all surfaces of the wavy fin sheets 19 and of the extruded layers 16. Furthermore, the wavy fin sheets 19 will induce turbulence in the air stream flowing through the gaseous fluid passages 12 thereby increasing the effective air to liquid contact for maximum water evaporation and cooling. Distribution of of the water into each of these passages adjacent the leading edges of the extruded layers 16 promotes uniformity of the water film over all the surfaces downstream thereof. The resulting improved evaporative cooling greatly enhances the cooling capacity of the heat exchanger 10 by increasing the heat transfer from the other fluid.

In the event that excess water is distributed into the gaseous fluid passages 12, as for example if the air entering the heat exchanger 10 through air inlet 11 is humid, i.e., already partly saturated with water vapor, the excess water is carried through the heat exchanger 10 by the moving air stream. To minimize this "blow through" and resultant loss of water, the trailing edge of the wavy fin sheets 19 are provided with an upper curving or concave surface adjacent the drain slot 23 for catching and raining the excess liquid into drain collector 24, from which it may be recirculated through the liquid passages 15. In order for the drain slot 23 and drain collector 24 to operate as explained above, the heat exchanger must be oriented with the drain collector 24 located at the bottom to provide for gravity drainage of the excess water. In the alternative, drain collector 24 may be left off the heat exchanger 10, and the heat exchanger oriented with the liquid passages 15 on top such that excess water will drain from the heat exchanger to a collector pan (not shown) disposed therebelow.

Flat fin sheets may be used in place of the wavy fin sheets 19; however, this will result in less turbulence in the air flow through gaseous fluid passages 12 with a resulting decrease in the effective air to liquid contact. Further, elimination of the upturned surface of the wavy fins 19 will render the drain slot 23 generally ineffective to collect excess liquid.

It will also be apparent to those skilled in the art, that other liquids besides water and other gaseous fluids besides air may be used in the subject invention with substantially the same benefits provided as explained above. The other fluid flowing through fluid passages 18 may be either a liquid or a gas, e.g., a refrigerant such as ammonia.

It is further contemplated, that a gravity flow liquid system might be utilized instead of a pumped liquid system, as for example, by replacing the liquid manifold **14*a* at the top of the heat exchanger 10 with a trough, in fluid communication with each of the liquid pasages 15. Liquid such as water supplied to fill the trough would be distributed throughout the heat exchanger 10** as explained above.

While the present invention has been described with respect to the preferred embodiments, it is to be understood that further modifications thereto would become apparent to those skilled in the art, which modifications lie within the scope of the present invention, as defined in the claims which follow.

I claim:

1. A heat exchanger for cooling a first fluid, comprising (a) a plurality of passages for conveying the first fluid through the heat exchanger, said passages being formed in generally rectangular extruded layers which are arranged in generally parallel, spaced apart relationship;

(b) a series of fin sheets disposed between the layers of extruded fluid passages, in spaced apart array, for defining passages for an air stream entering at one side of the heat exchanger and exiting the other side;

(c) water passages disposed at the side of the heat exchanger where the air stream enters, along an edge of the extruded layers, and operative to convey water along that edge for distribution into the adjacent air stream passages; and (d) slot means for distributing water flowing in the water passages into the adjacent air stream passages such that the water is induced to spread uniformly in a thin film over the surfaces of the air stream passages downstream of the slot means by the moving air stream, and to cool the first fluid by evaporation of the thin film of water.

2. The heat exchanger of claim 1 wherein the extruded layers include a plurality of hollow compartments arranged side-by-side across their width and extending along their length, which comprise the first fluid passages.

3. The heat exchanger of claim 2 wherein the leading hollow compartment on the side of the extruded layers where the air stream enters the heat exchanger, comprise the water passages.

4. The heat exchanger of claim 2 wherein the water passages are defined by the combination of the leading hollow compartment on the side of the extruded layers where the air stream enters the heat exchanger and an extruded strip attached to the edge of the extruded layers, said extruded strip including the slot means for distributing the water into the air stream passages.

5. The heat exchanger of claim 3 or 4 wherein the fin sheets are corrugated in wavy undulations and wherein the undulations thereof are generally transverse to the direction of the air stream, extending between adjacent extruded layers, whereby turbulence is induced in the air stream, thus improving heat transfer.

6. The heat exchanger of claim 4 wherein the heat exchanger is oriented with the wavy film sheets extending horizontally and with the undulation adjacent the trailing edge of the extruded layer curved upward, said trailing edge of the extruded layers being provided with a vertical slot to provide a drain in fluid communication with said adjacent undulations.

7. A heat exchanger for cooling a first fluid, comprising (a) a plurality of first fluid passages arranged in generally parallel, spaced apart layers, for separately conveying the first fluid through the heat exchanger;

(b) a plurality of gaseous fluid passages disposed between the layers of the first fluid passages, for conveying a gaseous fluid through the heat exchanger;

(c) a plurality of liquid passages, extending along a side of the heat exchanger where the gaseous fluid enters the gaseous fluid passages, for conveying a liquid therethrough;

(d) a series of metallic fin sheets disposed within the gaseous fluid passages in spaced apart arrangement, extending between adjacent first fluid passages; and (e) slot means in fluid communication with both the liquid and gaseous fluid passages, for distributing the liquid into the gaseous fluid passages in the space between the metallic sheets, such that the liquid is distributed on the surfaces of the metallic sheets and the adjacent layers of the first fluid passages, and is induced to spread in a thin film over these surfaces downstream of the slot means by the gaseous fluid flow, the evaporation of said thin film of liquid effecting significant cooling of the first fluid.

8. The heat exchanger of claim 7 wherein the first fluid and the gaseous fluid flow through their respective passages in generally transverse directions.

9. The heat exchanger of claim 8 wherein each of the liquid passages are disposed along an edge of and generally parallel to the layers of the first fluid passages.

10. The heat exchanger of claim 9 wherein the flow of gaseous fluid is in a generally horizontal direction, further comprising means for collecting excess liquid which has traversed the gaseous fluid passages without evaporating, such that the excess liquid flows downward under the force of gravity along an opposite side of the heat exchanger from where the gaseous fluid and the liquid enter.

11. A heat exchanger for cooling a first fluid, comprising (a) a plurality of first fluid passages formed in extruded layers, said layers being arranged in generally parallel spaced apart relationship, for conveying the first fluid through the heat exchanger;

(b) a plurality of gaseous fluid passages disposed adjacent the extruded layers of the first fluid passages in the space therebetween, and operative to convey a gaseous fluid through the heat exchanger, said gaseous fluid flowing in relatively fast moving streams generally transverse to the flow of the first fluid through the heat exchanger;

(c) liquid passages disposed at the side of the heat exchanger where the gaseous fluid enters the gaseous fluid passages, along an edge of the extruded first fluid passage layers, and operative to convey a liquid along that edge for distribution into the adjacent gaseous fluid passages;

(d) a series of fin sheets disposed within the gaseous fluid passages in spaced apart arrangement, extending between adjacent extruded layers of the first fluid passages;

(e) slot means formed in the liquid passages, for distributing the liquid into the gaseous fluid passages in the space between the fin sheets such that the liquid is induced to spread in a thin film on the surface of the fin sheets and over the adjacent surfaces of the extruded first fluid passages downstream of the slot means by the fast moving stream of the gaseous fluid, the evaporation of said thin film of liquid effecting significant cooling of the first fluid.

12. The heat exchanger of claim 11 wherein the extruded layers are generally rectangular and include a plurality of hollow compartments arranged side-by-side across their width and extending along their length, which comprise the first fluid passages.

13. The heat exchanger of claim 12 wherein the leading hollow compartment on the side of the extruded layers where the gaseous fluid enters the heat exchanger, comprises the liquid passages.

14. The heat exchanger of claim 12 wherein the leading hollow compartment on the side of the extruded layers where the gaseous fluid enters the heat exchanger together with an extruded strip attached along the edge thereof define the liquid passages, said extruded strip including the slot means for distributing the liquid into the gaseous fluid passages.

15. The heat exchanger of claim 13 or 14 wherein the fin sheets are corrugated in wavy undulations and wherein the undulations are generally transverse to the streams of the gaseous fluid, so that turbulence is induced in the streams of the gaseous fluid, improving heat transfer.

* * * * *